US011399696B2

(12) United States Patent
Durham

(10) Patent No.: US 11,399,696 B2
(45) Date of Patent: Aug. 2, 2022

(54) DISHWASHING APPLIANCES HAVING A HOT PLATE HEATER FOR DRYING

(71) Applicant: Haier US Appliance Solutions, Inc., Wilmington, DE (US)

(72) Inventor: Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 79 days.

(21) Appl. No.: 17/008,738

(22) Filed: Sep. 1, 2020

(65) Prior Publication Data

US 2022/0061629 A1 Mar. 3, 2022

(51) Int. Cl.
*A47L 15/42* (2006.01)
*A47L 15/48* (2006.01)

(52) U.S. Cl.
CPC ..... *A47L 15/48* (2013.01); *A47L 15/4285* (2013.01)

(58) Field of Classification Search
None
See application file for complete search history.

(56) References Cited

U.S. PATENT DOCUMENTS

| | | | |
|---|---|---|---|
| 3,555,242 | A | 1/1971 | Cushing |
| 9,034,112 | B2 | 5/2015 | Tuller |
| 9,668,636 | B2 | 6/2017 | Tuller |
| 2001/0042560 | A1 | 11/2001 | Helmut |
| 2013/0319482 | A1 | 12/2013 | Vallejo Noriega |
| 2020/0077867 | A1* | 3/2020 | Thiyagarajan ..... F28D 15/0275 |

* cited by examiner

*Primary Examiner* — Rita P Adhlakha
(74) *Attorney, Agent, or Firm* — Dority & Manning, P.A.

(57) ABSTRACT

A dishwashing appliance, as provided herein, may include a cabinet, a tub, a hot plate heater, a fan, and a conduit. The tub may be disposed within the cabinet and define a wash chamber. The hot plate heater may be in thermal communication with the tub. The hot plate heater may include a conductive body and a resistive heating element. The conductive body may have a chamber surface disposed within the wash chamber and an internal surface directed away from the wash chamber. The resistive heating element may be mounted outside of the wash chamber in thermal communication with the conductive body. The fan may be held within the cabinet outside of the wash chamber to motivate an airflow across the resistive heating element. The conduit may lead from an inlet disposed outside of the wash chamber to an outlet defined through the tub downstream from the fan.

19 Claims, 7 Drawing Sheets

DISHWASHING APPLIANCES HAVING A HOT PLATE HEATER FOR DRYING

FIELD OF THE INVENTION

The present subject matter relates generally to dishwashing appliances, and more particularly to assemblies and methods for heating dishwashing appliances.

BACKGROUND OF THE INVENTION

Modern dishwashing appliances (e.g., dishwashers) typically include a tub defining a wash chamber where, for instance, detergent, water, and heat can be applied in order to clean food or other materials from dishes and other articles being washed. During wash and rinse cycles, dishwashers typically circulate a fluid through a wash chamber over articles such as pots, pans, silverware, and other cooking utensils. The fluid can be, for example, various combinations of water and detergent during the wash cycle or water (which may include additives) during the rinse cycle. Typically the fluid is recirculated during a given cycle using a pump. Fluid is collected at or near the bottom of the wash chamber and pumped back into the chamber through, for example, nozzles in the spray arms and other openings that direct the fluid against the articles to be cleaned or rinsed. Fluids used in, for example, the wash or rinse cycles may be heated. For example, hot water may be supplied to the dishwasher or the dishwasher may include one or more heat sources for heating fluids used in wash or rinse cycle and for providing heat during a dry cycle.

It is common to provide dishwashers with rod-type, resistive heating elements in order to supply heat within the wash chamber during one or more of the dishwasher cycles (e.g., during the dry cycle). Generally, these heating elements include an electric resistance-type wire that is encased in a magnesium oxide-filled, metallic sheath. Unfortunately, such heating elements are generally visible to a consumer and can create an unattractive appearance. Moreover, any exposed element has the potential to snag certain objects or inadvertently trap fallen utensils.

Certain modern dishwashers have attempted to address some of the above issues with rod-type, resistive heating elements with a hot plate heater that generally only provides a single visible surface that is substantially flush with a bottom of the tub. Such heaters are able to heat water within the wash tub as such water passes over the visible surface. Use of such heaters is typically not possible, however, during dry cycles or cycles in which no water is flowing over the visible surface. This is commonly due, at least in part, to the high concentration of heat and heat generation at the hot plate heater, which risks damaging the surrounding portions of a dishwasher if water is not present to draw heat from (i.e., cool) the heater.

As a result, it may be useful to provide a dishwashing appliance or method that can address one or more of the above identified issues. In particular, it would be advantageous to have a dishwashing appliance or method for heating the wash chamber, especially during dry cycles, without risking damage to the appliance, cluttering the wash chamber, or reducing the overall size/complexity requirements of the appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a tub, a hot plate heater, a fan, and a conduit. The tub may be disposed within the cabinet and define a wash chamber. The hot plate heater may be in thermal communication with the tub and operable to heat the wash chamber. The hot plate heater may include a conductive body and a resistive heating element. The conductive body may have a chamber surface disposed within the wash chamber and an internal surface directed away from the wash chamber opposite of the chamber surface. The resistive heating element may be mounted outside of the wash chamber in thermal communication with the conductive body at the internal surface. The fan may be held within the cabinet outside of the wash chamber in fluid communication with the resistive heating element to motivate an airflow across the resistive heating element. The conduit may lead from an inlet disposed outside of the wash chamber to an outlet defined through the tub in fluid communication with the wash chamber downstream from the fan.

In another exemplary aspect of the present disclosure, a dishwashing appliance is provided. The dishwashing appliance may include a cabinet, a tub, a hot plate heater, a fan, a conduit, and a controller. The cabinet may define an interior. The tub may be disposed within the cabinet and define a wash chamber. The hot plate heater may be in thermal communication with the tub and operable to heat the wash chamber. The hot plate heater may include a conductive body and a resistive heating element. The conductive body may have a chamber surface disposed within the wash chamber and an internal surface directed away from the wash chamber opposite of the chamber surface. The conductive body may define a pocket open to the interior of the cabinet outside of the wash chamber. The resistive heating element may be mounted within the pocket in thermal communication with the conductive body at the internal surface, The fan may be held within the cabinet outside of the wash chamber in fluid communication with the resistive heating element to motivate an airflow across the resistive heating element. The conduit may lead from an inlet disposed outside of the wash chamber to an outlet defined through the tub in fluid communication with the wash chamber downstream from the fan. The controller may be operably coupled to the hot plate heater and the fan, the controller being configured to initiate a dry cycle. The dry cycle may include halting water flow through the wash chamber, activating the resistive heating element for heat generation of air within the cabinet, and motivating the airflow at the fan to the wash chamber during activating the resistive heating element.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
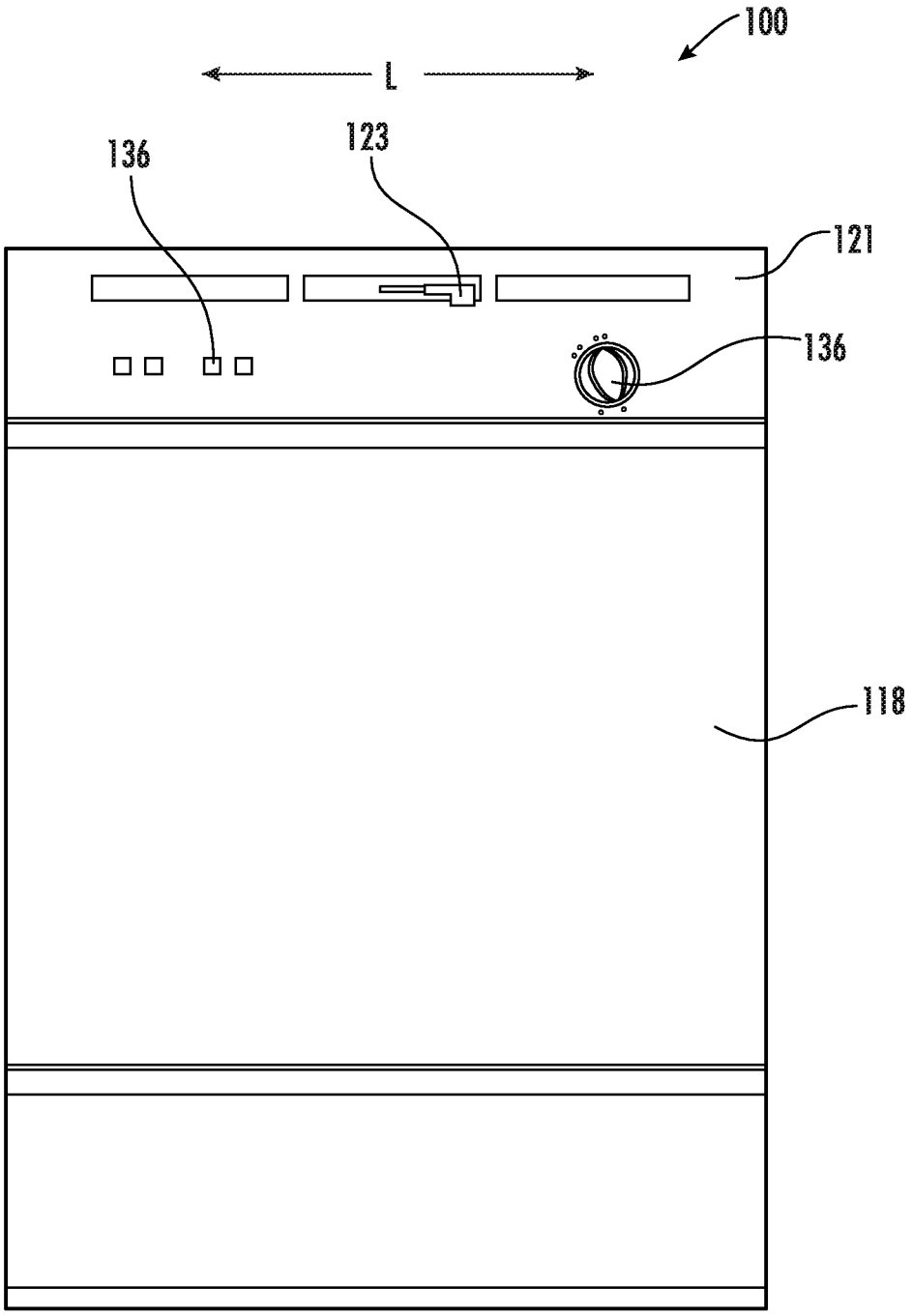
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
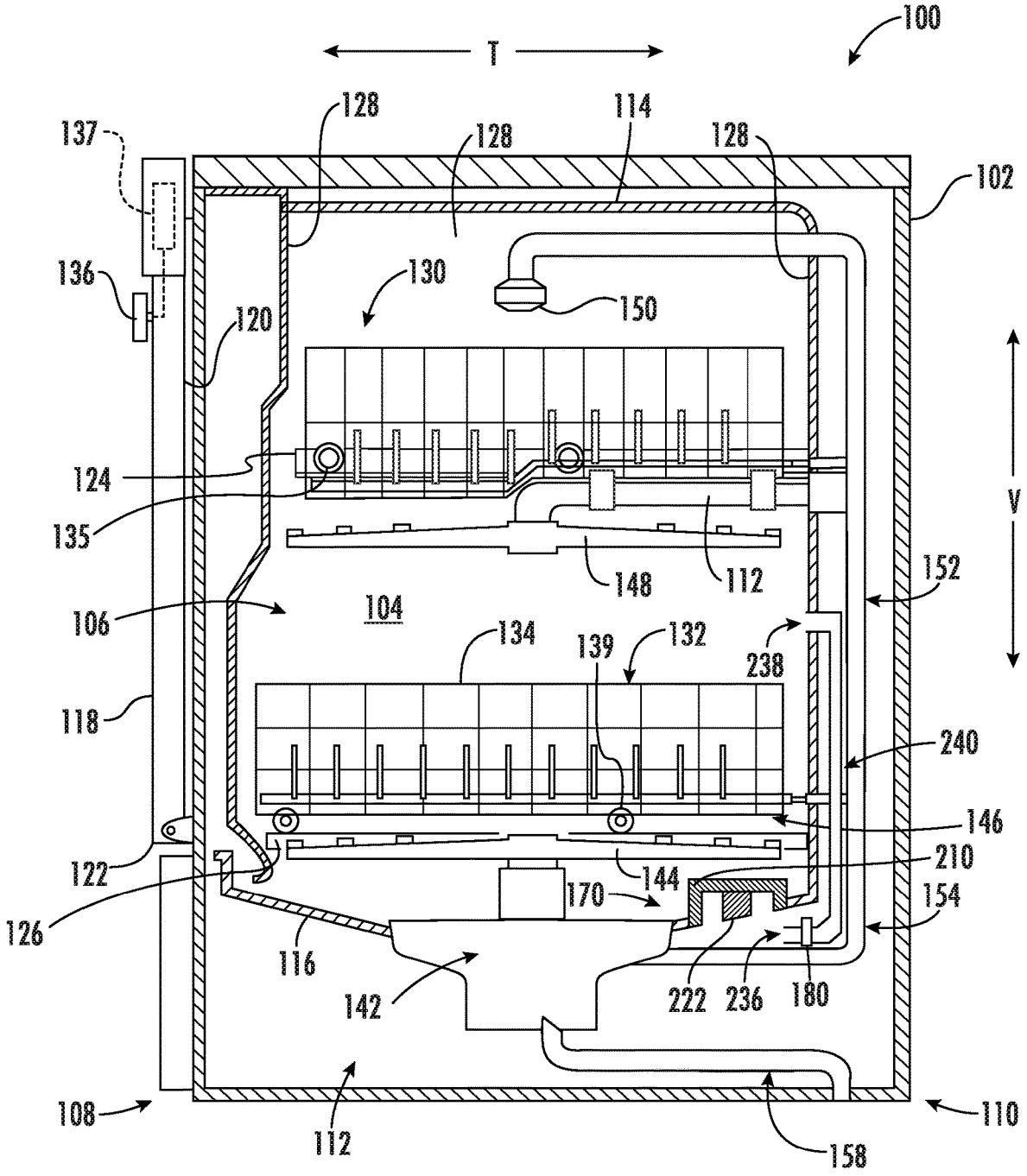
FIG. 2 provides a schematic, sectional, elevation view of the exemplary dishwashing appliance of FIG. 1.
Figure 3:
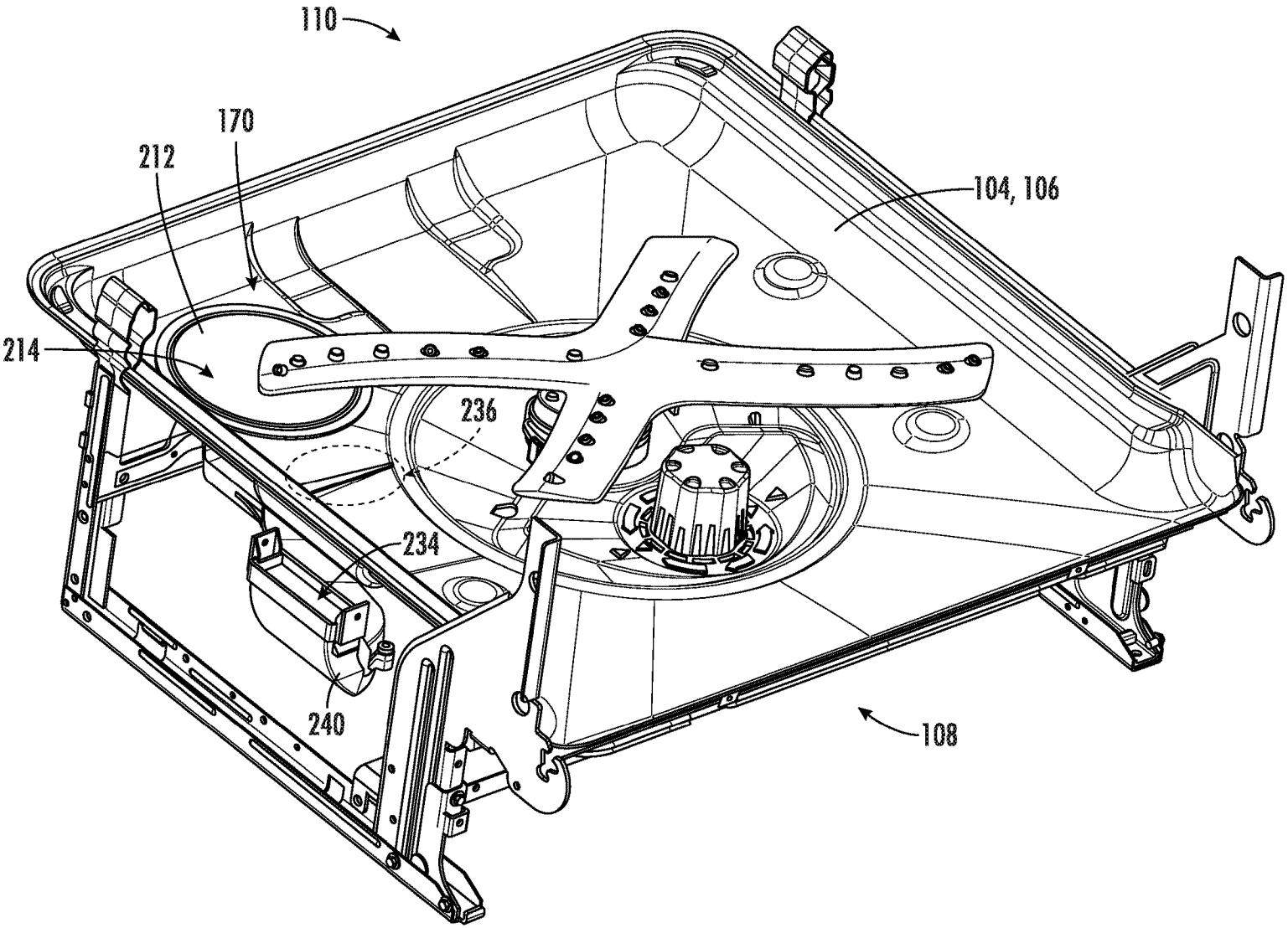
FIG. 3 provides a perspective view of a bottom portion of the tub and dishwashing appliance of FIG. 2.
Figure 4:
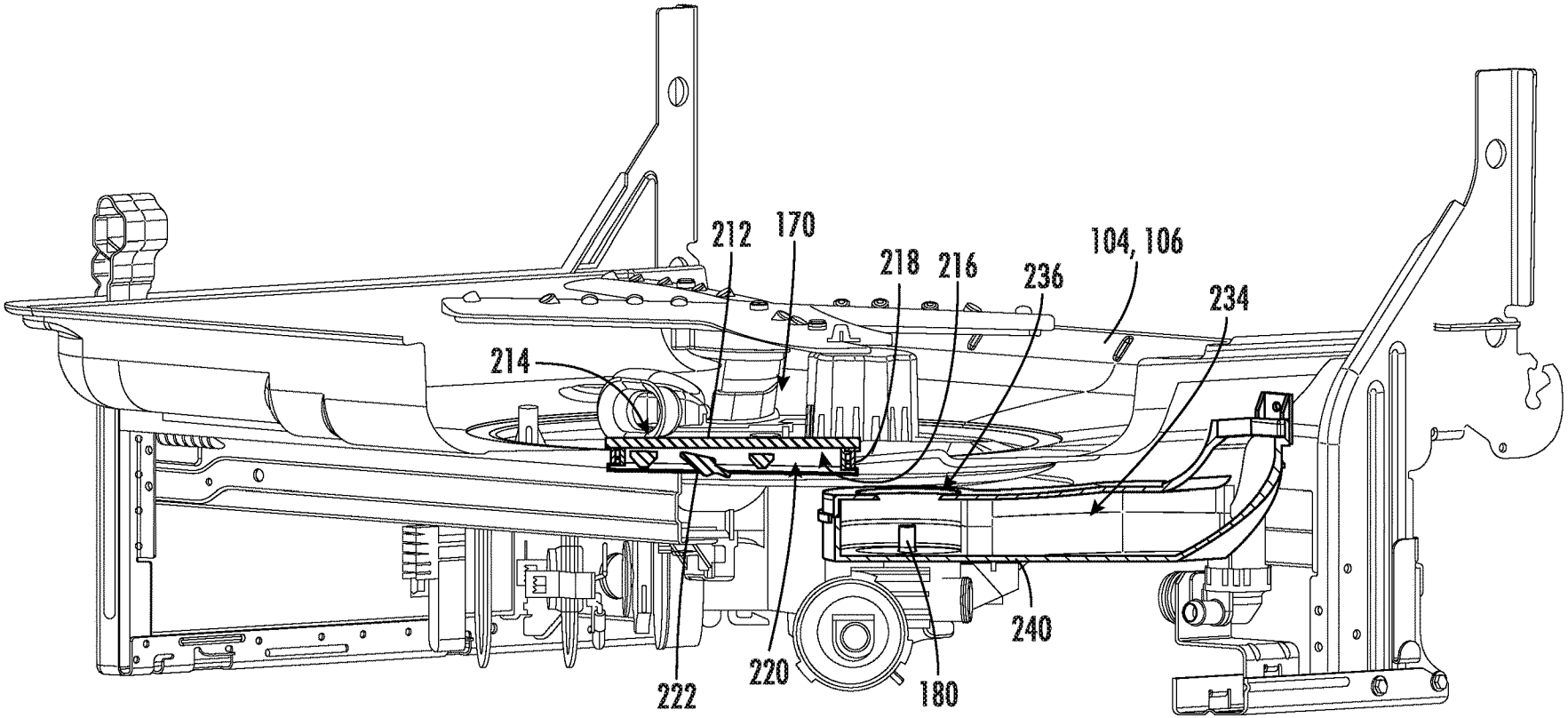
FIG. 4 provides a sectional perspective view of the dishwashing appliance of FIG. 3.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses water or detergent to, for example, remove soil particles including food and other undesirable elements from the articles FIGS. 1 and 2 depict an exemplary domestic dishwasher 100 that may be configured in accordance with aspects of the present disclosure. As shown, the dishwasher 100 includes a cabinet 102 having a tub 104 mounted therein (i.e., within an interior 112 of cabinet 102). As shown, tub 104 defines a wash chamber 106. In some embodiments, tub 104 includes a plurality of sidewalls 128 that at least partially define the wash chamber 106 (e.g., between a top wall 114 and a bottom wall 116). The tub 104 further includes a front opening and a door 118 hinged at its bottom 122 for movement between a closed (e.g., vertical) position (shown in FIGS. 1 and 2), wherein the wash chamber 106 is sealed shut for a washing operation or wash cycle, and an opened (e.g., fully or partially open) position for loading and unloading of articles from the dishwasher 100. Thus, access to wash chamber 106 is generally restricted in the closed position, while access to wash chamber 106 is permitted in the opened position. In some embodiments, a latch 123 is used to lock and unlock door 118 for access to chamber 106. Door 118 includes an inner wall 120. The inner wall 120 further defines the wash chamber 106 when the door 118 is in the closed position.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack assembly 130, 132 is arranged in the wash chamber 106, such that the rack assembly 130, 132 is capable of movement between an extended loading position (not shown) in which the rack is substantially positioned outside the wash chamber 106, and a retracted position (shown in FIGS. 1 and 2) in which the rack is located inside the wash chamber 106. This is, for example, facilitated by rollers 135 and 139, for example, mounted onto rack assemblies 130 and 132, respectively. A silverware basket (not shown) may be removably attached to rack assembly 132 for placement of silverware, utensils, and the like, that are otherwise too small to be accommodated by the rack assemblies 130, 132.

In some embodiments, the dishwasher 100 further includes a lower spray-arm assembly 144 that is rotatably mounted within a lower region 146 of the wash chamber 106 and above a sump 142 so as to rotate in relatively close proximity to rack assembly 132. In some embodiments, a mid-level spray-arm assembly 148 is located in an upper region of the wash chamber 106 and may be located in close proximity to upper rack 130. Additionally or alternatively, an upper spray assembly 150 may be located above the upper rack 130.

A hot plate heater 170 can be used to provide heat during, for example, a wash, rinse, or dry cycle. As will be described in detail below, heater 170 generally includes a resistive heating element 222 mounted outside of the wash chamber 106 and a conductive body 210 that has a chamber surface 214 disposed within the wash chamber 106. Generally, resistive heating element 222 may be provided as any suitable electrically driven heating element (e.g., sheathed heating element; nichrome wire, tungsten wire; tubular rod heater—such as those marketed under the name CAL-ROD®; etc.). When activated, heat generated at resistive heating element 222 may thus be transferred (e.g., conducted) through conductive body 210 and to wash chamber 106.

In some embodiments, an air handler or fan 180 is provided in fluid communication with hot plate heater 170. Specifically, and as will also be described in detail below, fan 180 may be mounted within cabinet 102 and outside of tub 104 or wash chamber 106. Thus, fan 180 may be selectively activated to motivate an airflow across at least a portion of hot plate heater 170 (e.g., resistive heating element 222).

As is understood, each spray-arm assembly 144, 148 includes an arrangement of discharge ports or orifices for directing fluid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 provides coverage of dishes and other dishwasher contents with a washing spray. Other configurations of spray assemblies may be used as well.

The lower and mid-level spray-arm assemblies 144, 148 and the upper spray assembly 150 may be provided as part of a fluid circulation assembly 152 for circulating water and dishwasher fluid in the tub 104. In some embodiments, fluid circulation assembly 152 includes a circulation conduit 154 that supplies the fluid to the lower and mid-level spray-arm assemblies 144, 148 or the upper spray assembly 150. The conduit 154 may, for example, be in fluid communication with the sump 142 (e.g., defined by bottom wall 116) such that fluid can flow from the sump 142 into the conduit 154 as required.

As noted above, dishwasher assembly 100 further includes sump 142 (e.g., defined by tub 104, such as by bottom wall 116), which may be provided in lower region 146 below, for example, lower spray-arm assembly 144. Sump 142 generally collects fluid from the wash chamber 106 for circulation within the tub 104, such as back into the wash chamber 106 through fluid circulation assembly 152, as well as drainage from the tub 104 and dishwashing appliance 100 in general. Drainage may occur, for example, through a drain conduit 158 that is provided for draining fluid from the sump 142. The conduit 158 may, for example, be in fluid communication with the sump 142 such that fluid can flow from the sump 142 into the conduit 158 as required. Drain conduit 158 may flow the fluid from the sump 142 to, for example, external plumbing or another suitable drainage location.

As shown, dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a wash cycle. The memory may represent random access memory such as DRAM, or read only memory such as ROM or FLASH. In some embodiments, the processor executes programming instructions stored in memory. For certain embodiments, the instructions include a software package configured to operate appliance 100. The memory may be a separate component from the processor or may be included onboard within the processor.

The controller 137 may be positioned in a variety of locations throughout dishwasher 100. For instance, the controller 137 may be located within a control panel area 121 of door 118 as shown in FIGS. 1 and 2. In such an embodiment, input/output ("I/O") signals may be routed between the control system and various operational components of dishwasher 100 along wiring harnesses that may be routed through the bottom 122 of door 118. Typically, the controller 137 includes a user interface panel or controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

In some embodiments, controller 137 is in communication with heater 170 or fan 180 via one or more signal lines or shared communication busses. Moreover, controller 137 is generally configured to selectively activate heater 170 or fan 180 according to one or more detected or predetermined conditions. For instance, controller 137 may be configured to initiate a washing operation that includes activating heater 170 or fan 180 during one or more cycles (e.g., wash cycles, rinse cycles, or dry cycles). Optionally, controller 137 may configured to selectively vary the wattage of heater 170. For instance, controller 137 may be configured to initiate adjustments of electrical power to heater 170 (e.g., according to which cycle is being performed).

It should be appreciated that the invention is not limited to any particular style, model, or configuration of dishwasher. The exemplary embodiments depicted in FIGS. 1 and 2 are for illustrative purposes only. For example, different locations may be provided for user interface 136, different configurations may be provided for racks 130, 132, and other differences may be applied as well.

Turning now to FIGS. 3 through 6, various views are provided of a bottom portion of tub 104, including bottom wall 116, heater 170, and fan 180. As noted above, hot plate heater 170 is generally provided in thermal communication with wash chamber 106. Specially, the chamber surface 214 of conductive body 210 may be defined by an upper plate 212 disposed within wash chamber 106 to conduct heat to wash chamber 106. Opposite of chamber surface 214, upper plate 212 may define an internal surface 216 directed away from the wash chamber 106 (e.g., to the interior 112 of cabinet 102 below tub 104). Hot plate heater 170 may thus be operable to direct heat through conductive body 210 (e.g., from internal surface 216 to chamber surface 214) to heat wash chamber 106 (i.e., heat the air or water within wash chamber 106).

In certain embodiments, hot plate heater 170 is mounted through or to one of the walls of tub 104. In the exemplary embodiments of FIGS. 3 through 6, hot plate heater 170 is mounted to bottom wall 116. For instance, bottom wall 116 may define a hole that at least a portion of conductive body 210 is held within. In some such embodiments, the hole is defined proximal to the rear end 110 and distal to the front end 108 along the transverse direction T. In other words, the hole may be closer to the rear end 110 than it is to the front end 108. Thus, hot plate heater 170 may be mounted proximal to the rear end 110 and distal to the front end 108. Advantageously, hot plate heater 170 may be disposed apart from the front opening, thereby avoiding a user's contact with or potential exposure to hot plate heater 170.

As shown, conductive body 210 may include a perimeter rim 218 extending (e.g., downward along the vertical direction V) from upper plate 212. Perimeter rim 218 may be a discrete, attached element or, alternatively, an integral monolithic unit with upper plate 212. In some embodiments, perimeter rim 218 extends through tub 104. For instance, perimeter rim 218 may extend through the hole defined by bottom wall 116. Optionally, perimeter rim 218 may join to a separate bracket or directly to tub 104 (e.g., via a suitable mechanical fastener, adhesive, etc.).

When assembled, conductive body 210 may define a pocket 220 that is open to a portion of interior 112 outside of wash chamber 106 (e.g., below tub 104). Specifically, the pocket 220 may be defined as a partially enclosed region. Advantageously, air and heat may pass between the pocket 220 and the interior 112. In some embodiments, perimeter rim 218 and upper plate 212 define pocket 220. In other words, perimeter rim 218 and upper plate 212 may define the bounds of pocket 220. For instance, internal surface 216 may define the upper bounds of pocket 220 while perimeter rim 218 may define the horizontal bounds of pocket 220. The opening to pocket 220 may be defined at an opposite end of the perimeter rim 218 from upper plate 212.

One or more resistive heating elements 222 may be provided in thermal communication (e.g., convective or conductive thermal communication) with conductive body 210. Specifically, the one or more resistive heating elements 222 are mounted outside of wash chamber 106 and adjacent or proximal to internal surface 216. Thus, at least one resistive heating element 222 is in thermal communication with conductive body 210 at the internal surface 216. Resistive heating element 222 may be in contact with conductive body 210 or, alternatively, spaced apart from conductive body 210. Water within wash chamber 106 may be prevented from flowing to or contacting resistive heating element 222. For instance, conductive body 210 may block the flow of water within wash chamber 106 from flowing to resistive heating element 222. In some embodiments, resistive heating element 222 is disposed beneath chamber surface 214 (e.g., directly below upper plate 212). Optionally, resistive heating element 222 may be mounted at a location lower than upper plate 212 and at least a portion of bottom wall 116. In additional or alternative embodiments, resistive heating element 222 is received within pocket 220. During use (e.g., when a resistive heating element 222 is activated), heat generated at a resistive heating element 222 may be directed to the internal surface 216 (e.g., via conduction or natural heat convection).

Figure 7:
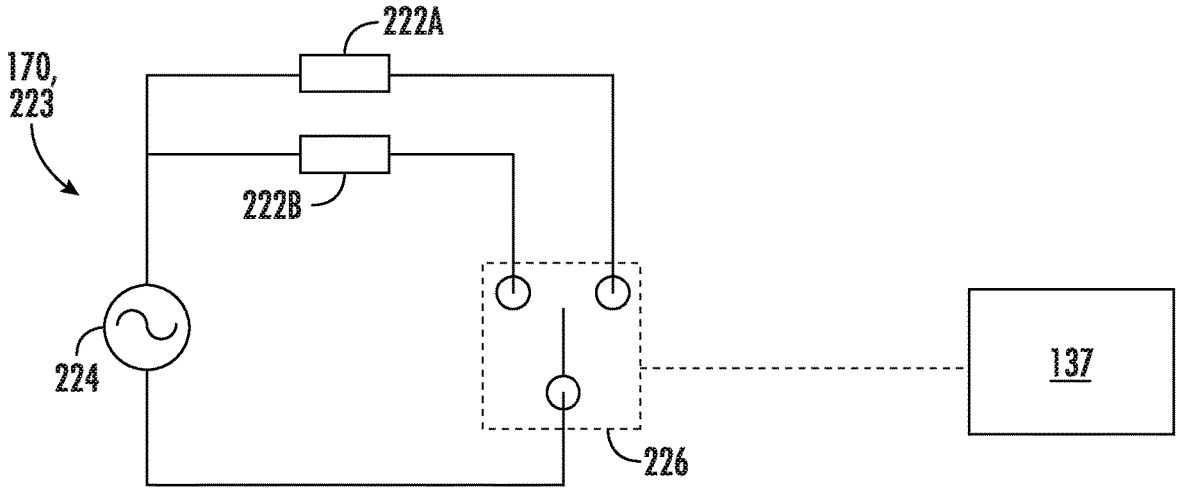
FIG. 7 provides a schematic view of hot plate heater of a dishwashing appliance according to exemplary embodiments of the present disclosure.
Figure 8:
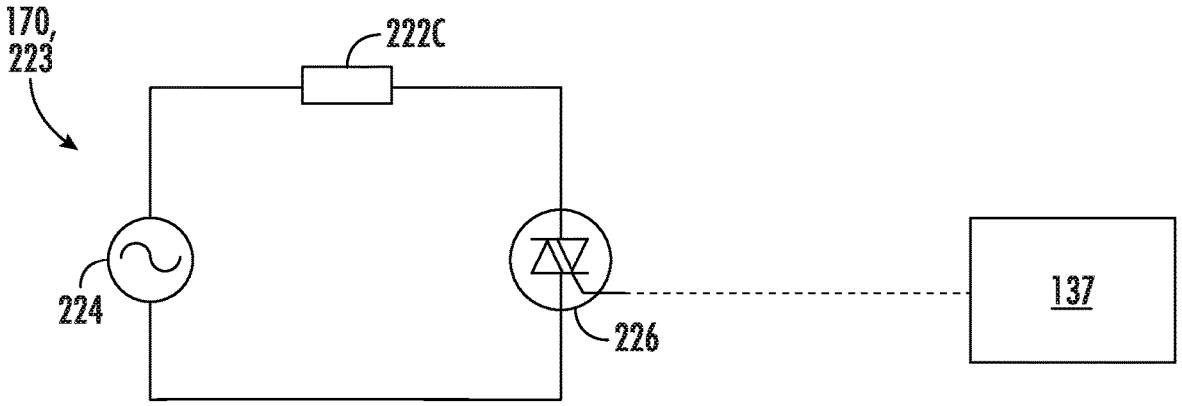
FIG. 8 provides a schematic view of hot plate heater of a dishwashing appliance according to other exemplary embodiments of the present disclosure.

Turning briefly to FIGS. 7 and 8, schematic views of exemplary embodiments of hot plate heater 170. In some embodiments, the one or more resistive heating elements 222 may be provided as a variable-wattage heating circuit 223.

As an example, multiple single-wattage heating elements (e.g., a high-wattage, wet-cycle element 222A for wash or rinse cycles and a low-wattage, dry-cycle element 222B for dry cycles) may be provided within the variable-wattage heating circuit 223, which may be configured to selectively alternate the power or wattage between the multiple single-wattage heating elements 222A, 222B. A voltage source 224 and one or more switching elements 226 (e.g., double throw switch, changeover switch, etc.) may be electrically coupled to the multiple single-wattage heating elements 222A, 222B as part of the variable-wattage heating circuit 223. Controller 137 may be operably connected to a switching element 226. Power or wattage may be varied by selectively switching or changing the position of switching element 226 to change which of the multiple single-wattage heating element receives a voltage (e.g., A/C voltage) from voltage source 224.

As an additional or alternative example, a particular heating element 222C may be provided within the variable-wattage heating circuit 223, which may be configured to selectively vary the power or wattage to that particular heating element 222C. A voltage source 224 and one or more switching elements 226 (e.g., relay, thyristor, etc.) may be electrically coupled to the particular heating element 222C as part of the variable-wattage heating circuit 223. Controller 137 may be operably connected to a switching element 226. Optionally, power or wattage to heating element 222C may be varied by selectively activating switching element 226 to cycle an A/C voltage from voltage source 224. Voltage to heating element 222C may thus be rapidly cycled off and on according to the state of the switching element 226, such as for a relay. Continuous (i.e., non-cycled) operation of heating element 222C will generally correspond to a higher wattage output of heating element 222C (in comparison to cycled operation, in which power to heating element 222C is restricted). As power or wattage to heating element 222C is varied, the wattage output of heating element 222C may thus be adjusted. Additionally or alternatively, power or wattage to heating element 222C may be directly varied as a percentage of a set wattage from voltage source, such as for a thyristor or TRIAC.

As shown, fan 180 is held or otherwise mounted within a portion of cabinet 102 outside of wash chamber 106 (e.g., within interior 112). Fan 180 may be provided as any suitable fan, air handler, or blower; such as an axial fan or centrifugal fan. When assembled, fan 180 is positioned in fluid communication with at least a portion of hot plate heater 170 to motivate an airflow (e.g., cooling airflow 230) across resistive heating element 222 (e.g., when fan 180 is rotated or otherwise activated). For instance, fan 180 may be mounted upstream or, alternatively, downstream from hot plate heater 170. The airflow motivated by fan 180 (e.g., cooling airflow 230) may advantageously accelerate the heat exchange between resistive heating element 222 and the surrounding air such that resistive heating element 222 is cooled and the motivated airflow is heated, such as during a dry cycle.

In exemplary embodiments, fan 180 is mounted or disposed below hot plate heater 170. For instance, fan 180 may be disposed directly beneath (e.g., vertically aligned below) hot plate heater 170 or, alternatively, horizontally offset from hot plate heater 170 at a lower location along the vertical direction V. Moreover, fan 180 may be disposed below resistive heating element 222 or pocket 220 (e.g., to motivate airflow across or through the same).

An airflow path 234 is defined within cabinet 102 to direct or guide the airflow (e.g., cooling airflow 230) motivated by fan 180. Specifically, airflow path 234 extends within cabinet 102 from an inlet 236 to an outlet 238. The inlet 236 is generally disposed outside of wash chamber 106 (e.g., within interior 112 upstream or, alternatively, downstream from fan 180) to receive air (e.g., as part of cooling airflow 230) from the interior 112 or ambient environment. The outlet 238 is generally disposed downstream of inlet 236 and fan 180. Moreover, outlet 238 is disposed upstream of wash chamber 106. For instance, outlet 238 maybe defined through tub 104 (e.g., through a sidewall 128). During use, the airflow 230 motivated by fan 180 may pass across resistive heating element 222 and through inlet 236, along airflow path 234, and exit into wash chamber 106 through outlet 238.

As shown, airflow path 234 may be defined by a conduit 240 held within cabinet 102. In turn, airflow path 234 may be defined separately from the rest of interior 112. Conduit 240 may thus extend from inlet 236 to outlet 238. In certain embodiments, inlet 236 is disposed below hot plate heater 170 (e.g., below bottom wall 116) while outlet 238 is disposed above hot plate heater 170 (e.g., through a sidewall 128). Optionally, fan 180 may be mounted to conduit 240, such as a location downstream from inlet 236 and upstream from outlet 238.

In some embodiments, controller 137 is in operative communication with (i.e., operably coupled to) both hot plate heater 170 and fan 180 to coordinate activation of both (e.g., based on the cycle being performed).

Figure 6:
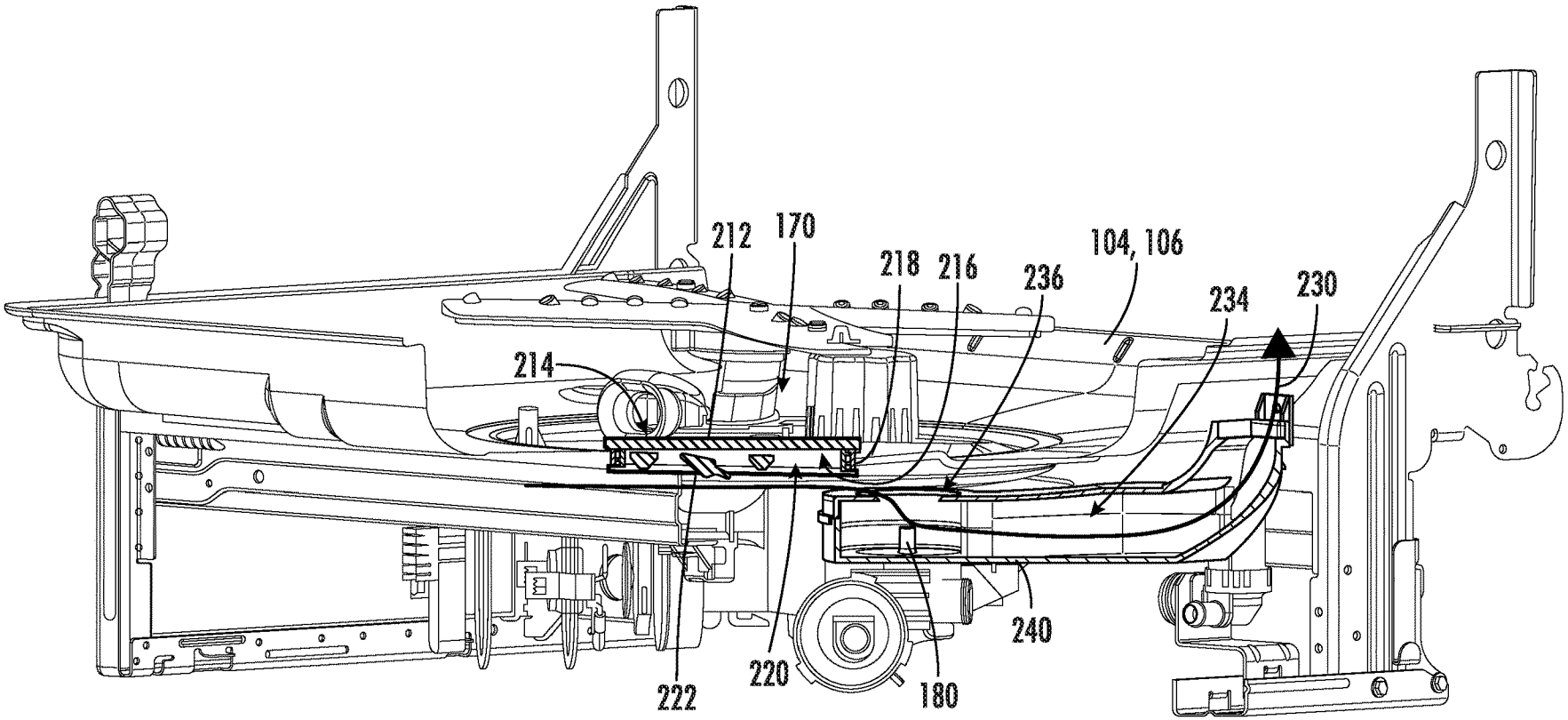
FIG. 6 provides a sectional perspective view of the dishwashing appliance of FIG. 3 during a heated dry cycle.

As an example, controller 137 may be configured to initiate a dry cycle (e.g., following a wash or rinse cycle as part of a washing operation) in which hot plate heater 170 and fan 180 are activated, which is illustrated especially in FIG. 6. The dry cycle may include halting water flow through wash chamber 106 (e.g., such that a water source is prevented from adding water to wash chamber 106). A circulation pump may be prevented from pumping water to or through wash chamber 106. Nonetheless, the dry cycle may include opening drain conduit 158 (FIG. 2) or activating a drain pump to pump water out of wash chamber 106. Following or in tandem with halting water flow, the dry cycle may include activating the resistive heating element 222. Specifically, a voltage may be directed to resistive heating element 222, generating heat to be absorbed by the surrounding air (e.g., within pocket 220 or interior 112). In embodiments including a variable-wattage heating assembly 224, resistive heating element 222 may be activated according to a relatively low wattage (e.g., a low wattage heating element may be activated or a variable wattage heating element may be activated at a low wattage output greater than 0). While resistive heating element 222 is active (e.g., beginning prior to, in tandem with, or following the start of activation of the resistive heating element 222), the airflow may be motivated at the fan 180. In other words, the fan 180 may be rotated or otherwise activated to motivate the cooling airflow 230 across at least a portion of hot plate heater 170 (e.g., as described above).

Figure 5:
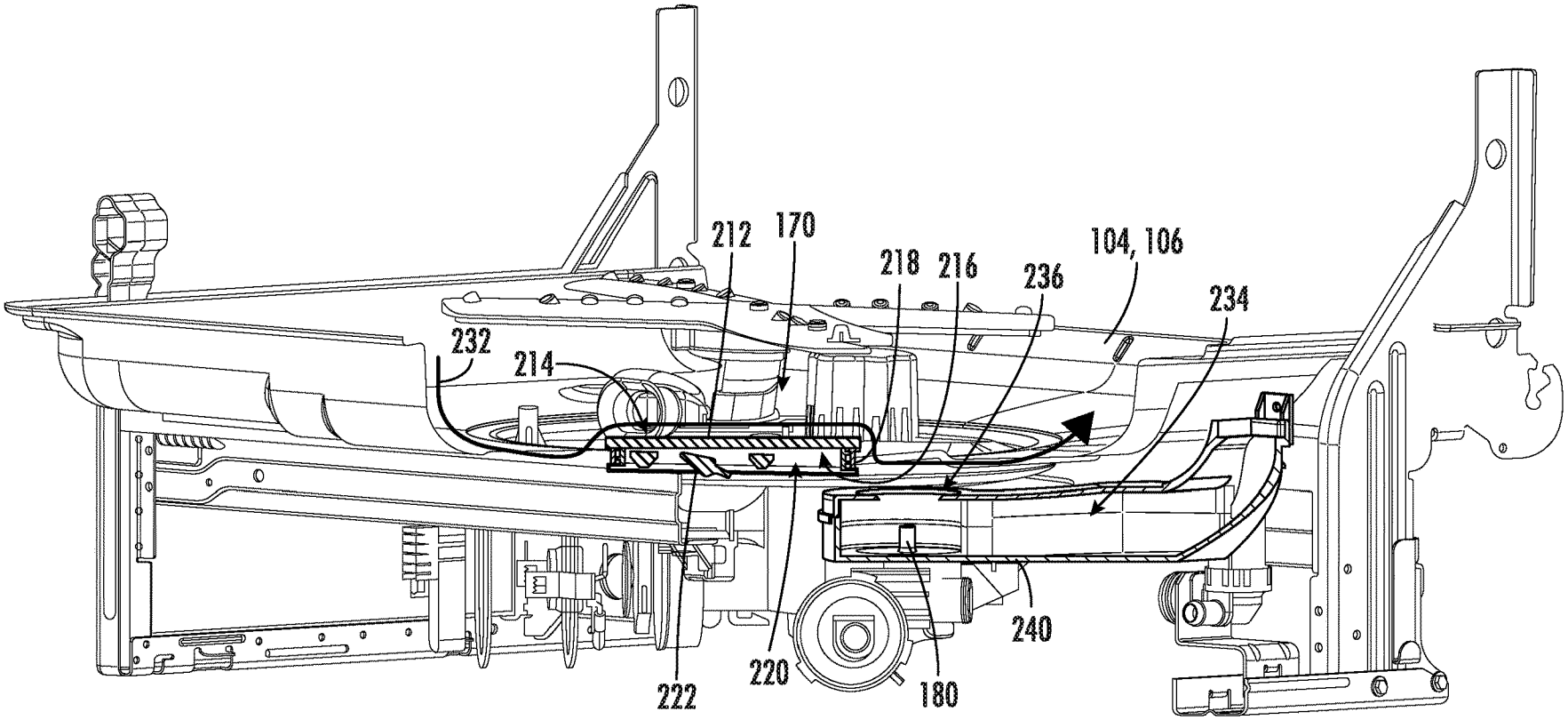
FIG. 5 provides a sectional perspective view of the dishwashing appliance of FIG. 3 during a heated wet cycle.

As an additional or alternative example, controller 137 may be configured to initiate a wet cycle (e.g., a wash cycle or rinse cycle as part of a washing operation and separate from a dry cycle) in which hot plate heater 170 and fan 180 are activated, which is illustrated especially in FIG. 5. The wet cycle may include circulating a water flow through the wash chamber 106. For instance, a circulation pump may be activated to pump water to or through wash chamber 106 (e.g., from conduit 154—FIG. 2). Additionally or alternatively, a valve downstream from a water source may be opened to permit water to flow to wash chamber 106 from outside of dishwasher 100, as is understood. While water is circulating, the wet cycle may include activating the resistive heating element 222. Specifically, a voltage may be directed to resistive heating element 222, generating heat to be received at conductive body 210 and absorbed by the water flow across conductive body 210 (e.g., within wash chamber 106). In embodiments including a variable-wattage heating assembly 224, resistive heating element 222 may be activated according to a relatively high wattage (e.g., a high wattage heating element may be activated or a variable wattage heating element may be activated at a high wattage output greater than the low wattage output). While resistive heating element 222 is active (e.g., beginning prior to, in tandem with, or following the start of activation of the resistive heating element 222), the airflow (e.g., cooling airflow 230—FIG. 6) at the fan 180 may be halted. For instance, fan 180 may be held in an inactive state, thereby preventing motivation of the airflow across hot plate heater 170. In turn, heat generated at hot plate heater 170 may be focused to wash chamber 106.

Advantageously, the above-described embodiments may permit activation of hot plate heater 170 for heating air during a dry cycle without requiring a heating element within wash chamber 106. Additionally or alternatively, hot plate heater 170 may be prevented from overheating (e.g., during a dry cycle).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:
- a cabinet;
- a tub disposed within the cabinet and defining a wash chamber;
- a hot plate heater in thermal communication with the tub and operable to heat the wash chamber, the hot plate heater comprising
  - a conductive body having a chamber surface disposed within the wash chamber and an internal surface directed away from the wash chamber opposite of the chamber surface, and
  - a resistive heating element mounted outside of the wash chamber in thermal communication with the conductive body at the internal surface;
- a fan held within the cabinet outside of the wash chamber in fluid communication with the resistive heating element to motivate an airflow across the resistive heating element; and
- a conduit leading from an inlet disposed outside of the wash chamber to an outlet defined through the tub in fluid communication with the wash chamber downstream from the fan.

2. The dishwashing appliance of claim 1, wherein the resistive heating element is disposed beneath the chamber surface.

3. The dishwashing appliance of claim 1, wherein the tub comprises a bottom wall defining a sump portion, wherein the hot plate heater is mounted to the bottom wall.

4. The dishwashing appliance of claim 1, wherein the wash chamber extends along a transverse direction from a rear end to a front end defining a chamber opening, and wherein the hot plate heater is mounted proximal to the rear end and distal to the front end.

5. The dishwashing appliance of claim 1, wherein the conductive body defines a pocket open to an interior of the cabinet outside of the wash chamber, and wherein the resistive heating element is received within the pocket.

6. The dishwashing appliance of claim 1, further comprising a variable-wattage heating circuit in thermal communication with the conductive body, wherein the variable-wattage heating circuit comprises the resistive heating element.

7. The dishwashing appliance of claim 1, wherein the fan is disposed below the hot plate heater.

8. The dishwashing appliance of claim 1, wherein the tub comprises a top wall, a bottom wall, and sidewalls extending between the top and bottom walls, and wherein the outlet is defined through a sidewall of the tub.

9. The dishwashing appliance of claim 1, further comprising a controller operably coupled to the hot plate heater and the fan, wherein the controller is configured to initiate a dry cycle comprising:
- halting water flow through the wash chamber,
- activating the resistive heating element for heat generation of air within the cabinet, and
- motivating the airflow at the fan to the wash chamber during activating the resistive heating element.

10. The dishwashing appliance of claim 9, wherein the controller is further configured to initiate a wet cycle apart from the dry cycle, the wet cycle comprising:
- circulating a water flow through the wash chamber, and
- activating the resistive heating element for heat generation of water within the wash chamber.

11. A dishwashing appliance comprising:

a cabinet defining an interior;

a tub disposed within the cabinet and defining a wash chamber;

a hot plate heater in thermal communication with the tub and operable to heat the wash chamber, the hot plate heater comprising a conductive body having a chamber surface disposed within the wash chamber and an internal surface directed away from the wash chamber opposite of the chamber surface, the conductive body defining a pocket open to the interior of the cabinet outside of the wash chamber, and a resistive heating element mounted within the pocket in thermal communication with the conductive body at the internal surface;

a fan held within the cabinet outside of the wash chamber in fluid communication with the resistive heating element to motivate an airflow across the resistive heating element; and a conduit leading from an inlet disposed outside of the wash chamber to an outlet defined through the tub in fluid communication with the wash chamber downstream from the fan; and a controller operably coupled to the hot plate heater and the fan, the controller being configured to initiate a dry cycle comprising:

halting water flow through the wash chamber, activating the resistive heating element for heat generation of air within the cabinet, and motivating the airflow at the fan to the wash chamber during activating the resistive heating element.

12. The dishwashing appliance of claim 11, wherein the resistive heating element is disposed beneath the chamber surface.

13. The dishwashing appliance of claim 11, wherein the tub comprises a bottom wall defining a sump portion, wherein the hot plate heater is mounted to the bottom wall.

14. The dishwashing appliance of claim 11, wherein the wash chamber extends along a transverse direction from a rear end to a front end defining a chamber opening, and wherein the hot plate heater is mounted proximal to the rear end and distal to the front end.

15. The dishwashing appliance of claim 11, wherein the conductive body defines a pocket open to an interior of the cabinet outside of the wash chamber, and wherein the resistive heating element is received within the pocket.

16. The dishwashing appliance of claim 11, further comprising a variable-wattage heating circuit in thermal communication with the conductive body, wherein the variable-wattage heating circuit comprises the resistive heating element.

17. The dishwashing appliance of claim 11, wherein the fan is disposed below the hot plate heater.

18. The dishwashing appliance of claim 11, wherein the tub comprises a top wall, a bottom wall, and sidewalls extending between the top and bottom walls, and wherein the outlet is defined through a sidewall of the tub.

19. The dishwashing appliance of claim 11, wherein the controller is further configured to initiate a wet cycle apart from the dry cycle, the wet cycle comprising:

circulating a water flow through the wash chamber, and activating the resistive heating element for heat generation of water within the wash chamber.

* * * * *